US008057362B2

(12) United States Patent
Nadim

(10) Patent No.: US 8,057,362 B2
(45) Date of Patent: Nov. 15, 2011

(54) EXERCISE DEVICE AND METHOD OF USING SAME

(76) Inventor: Yasser Nadim, Somerset, KY (US)

( * ) Notice: Subject to any disclaimer, the term of this patent is extended or adjusted under 35 U.S.C. 154(b) by 0 days.

(21) Appl. No.: 13/010,822

(22) Filed: Jan. 21, 2011

(65) Prior Publication Data

US 2011/0118096 A1 May 19, 2011

Related U.S. Application Data

(63) Continuation-in-part of application No. 12/729,031, filed on Mar. 22, 2010, now Pat. No. 7,955,240.

(60) Provisional application No. 61/305,748, filed on Feb. 18, 2010, provisional application No. 61/268,445, filed on Jun. 12, 2009.

(51) Int. Cl.
*A63B 22/00* (2006.01)
*A63B 22/16* (2006.01)

(52) U.S. Cl. ..... 482/51; 482/70; 482/146

(58) Field of Classification Search ..... 482/140, 482/147, 146, 129–130, 110, 51
See application file for complete search history.

(56) References Cited

U.S. PATENT DOCUMENTS 2,274,081 A * 2/1942 Mautin ..... 482/71
3,147,972 A * 9/1964 Borsuk ..... 472/29
3,531,110 A * 9/1970 Marchu ..... 482/71
3,834,693 A * 9/1974 Poppenberger ..... 482/71
3,911,907 A * 10/1975 Smith, Jr. ..... 482/1
3,936,047 A 2/1976 Brandt et al.
3,993,304 A * 11/1976 Ahrens ..... 472/59
4,305,579 A * 12/1981 Rice ..... 482/147
4,390,180 A 6/1983 Simjian
4,396,189 A * 8/1983 Jenkins ..... 482/71
4,544,153 A * 10/1985 Babcock ..... 482/71
4,930,771 A * 6/1990 Wilson ..... 482/145
4,961,574 A * 10/1990 Lew ..... 472/17
5,192,258 A * 3/1993 Keller ..... 482/71
5,632,711 A 5/1997 Hwang
5,692,995 A * 12/1997 Alvarez et al. ..... 482/71
5,711,749 A 1/1998 Miller
6,669,610 B2 12/2003 Slowinski
6,851,748 B1 * 2/2005 Garrick ..... 297/240
7,115,073 B2 * 10/2006 Nizamuddin ..... 482/51
7,303,508 B2 12/2007 Toyama et al.

(Continued)

OTHER PUBLICATIONS abGlider—http://proform.com.

(Continued)

*Primary Examiner* — Stephen Crow
(74) *Attorney, Agent, or Firm* — Stoll Keenon Ogden, PLLC; Rebecca Ann Krafft

(57) ABSTRACT

An exercise device provides a revolving range of motion around an axis designed to provide an exercise of the whole torso muscles in one block. Multiple embodiments include a base frame, an arm portion connected to and extending from the base frame and a rotatable platform mounted on the arm portion. In some embodiments, the arm portion is adjustable and is configured to form a plurality of angles with the base frame, and the platform is configured to be mounted on the arm portion at a plurality of distances from a center of the base frame. Other embodiments include a base frame, a substantially enclosed track mounted on the base frame, a rolling mechanism that rides on the substantially enclosed track and a rotatable platform that rides on the rolling mechanism.

8 Claims, 18 Drawing Sheets

U.S. PATENT DOCUMENTS

| | | | | |
|---|---|---|---|---|
| 7,438,675 | B2 | 10/2008 | Lin | |
| 7,455,633 | B2 | 11/2008 | Brown et al. | |
| 7,473,210 | B1 * | 1/2009 | Hsiung | 482/51 |
| 7,485,079 | B2 | 2/2009 | Brown et al. | |
| 7,559,882 | B2 | 7/2009 | Chou | |
| D598,965 | S | 8/2009 | Augustine et al. | |
| 7,585,263 | B2 | 9/2009 | Brown et al. | |
| 7,611,445 | B2 | 11/2009 | Brown et al. | |
| 7,775,944 | B1 * | 8/2010 | Shultz | 482/92 |
| 7,775,953 | B2 * | 8/2010 | Wang | 482/147 |
| 7,883,426 | B2 * | 2/2011 | Bellows et al. | 472/119 |
| 2002/0177511 | A1 | 11/2002 | Jang | |
| 2004/0242381 | A1 | 12/2004 | Parmater | |
| 2007/0259760 | A1 | 11/2007 | Perez | |
| 2009/0124472 | A1 | 5/2009 | Chou | |

OTHER PUBLICATIONS

AbFlyer—http://abflyer.com.

* cited by examiner

EXERCISE DEVICE AND METHOD OF USING SAME

CROSS-REFERENCE TO RELATED APPLICATIONS

This application claims priority as a continuation-in-part application of U.S. patent application Ser. No. 12/729,031, entitled "Exercise Device and Method of Using Same" and filed on Mar. 22, 2010, which claims priority to U.S. Provisional Application No. 61/268,445, filed Jun. 12, 2009, and U.S. Provisional Application No. 61/305,748, filed Feb. 18, 2010, each of which is incorporated by reference herein in its entirety.

BRIEF DESCRIPTION OF THE DRAWINGS

The foregoing summary, as well as the following description of embodiments of the application, will be better understood when read in conjunction with the appended drawings. The drawings and embodiments described within this specification are to be understood as illustrative of structures, features and aspects of the present invention and not as limiting the scope of the invention. It should be understood that the application is not limited to the precise arrangements and instrumentalities shown. In the drawings.

MULTIPLE EMBODIMENTS AND ALTERNATIVES

Figure 1:
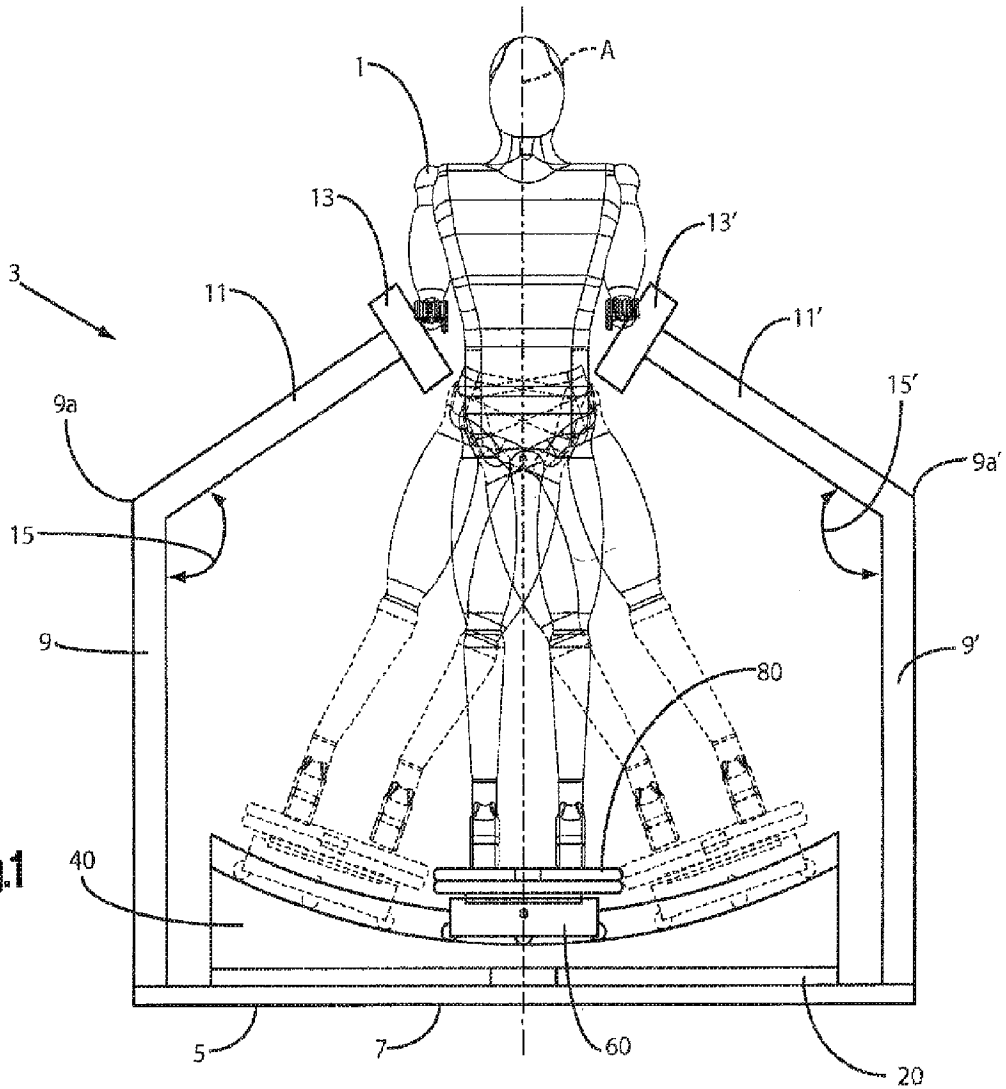
FIG. 1 is a schematic illustration of a front view of an exercise device in accordance with an embodiment of the present invention.

The methods and embodiments described within this specification are to be understood as illustrative and exemplary of the composition, structures, features and aspects of the present invention and not as limiting the scope of the invention. Certain terminology is used in the following description for convenience only and is not limiting. The words "right", "left", "top" and "bottom" designate directions in the drawings to which reference is made. The words "inwardly" and "outwardly" refer to directions toward and away from, respectively, the geometric center of the device and designated parts thereof. The words, "anterior", "posterior", "superior", "inferior", "lateral" and related words and/or phrases designate preferred positions and orientations in the human body to which reference is made and are not meant to be limiting. The terminology includes the above-listed words, derivatives thereof and words of similar import.

Referring now collectively to the Figures, in the various embodiments of the invention, an exercise device provides multiple ranges of motion designed to provide an abdominal exercise that targets various different abdominal muscle regions, and may also provide an aerobic and/or cardiac workout. In some embodiments, the exercise device 3 includes at least two selectably rotatable platforms 20, 80 wherein the second rotatable platform rides on a selectably lockable rolling mechanism 60. The rolling mechanism rides on a curved track 40 mounted on the first rotatable platform 20. By selectively locking the first and/or second platforms 20, 80 or the rolling mechanism 60, a user can achieve a desired workout that targets selected muscle groups.

Figure 2:
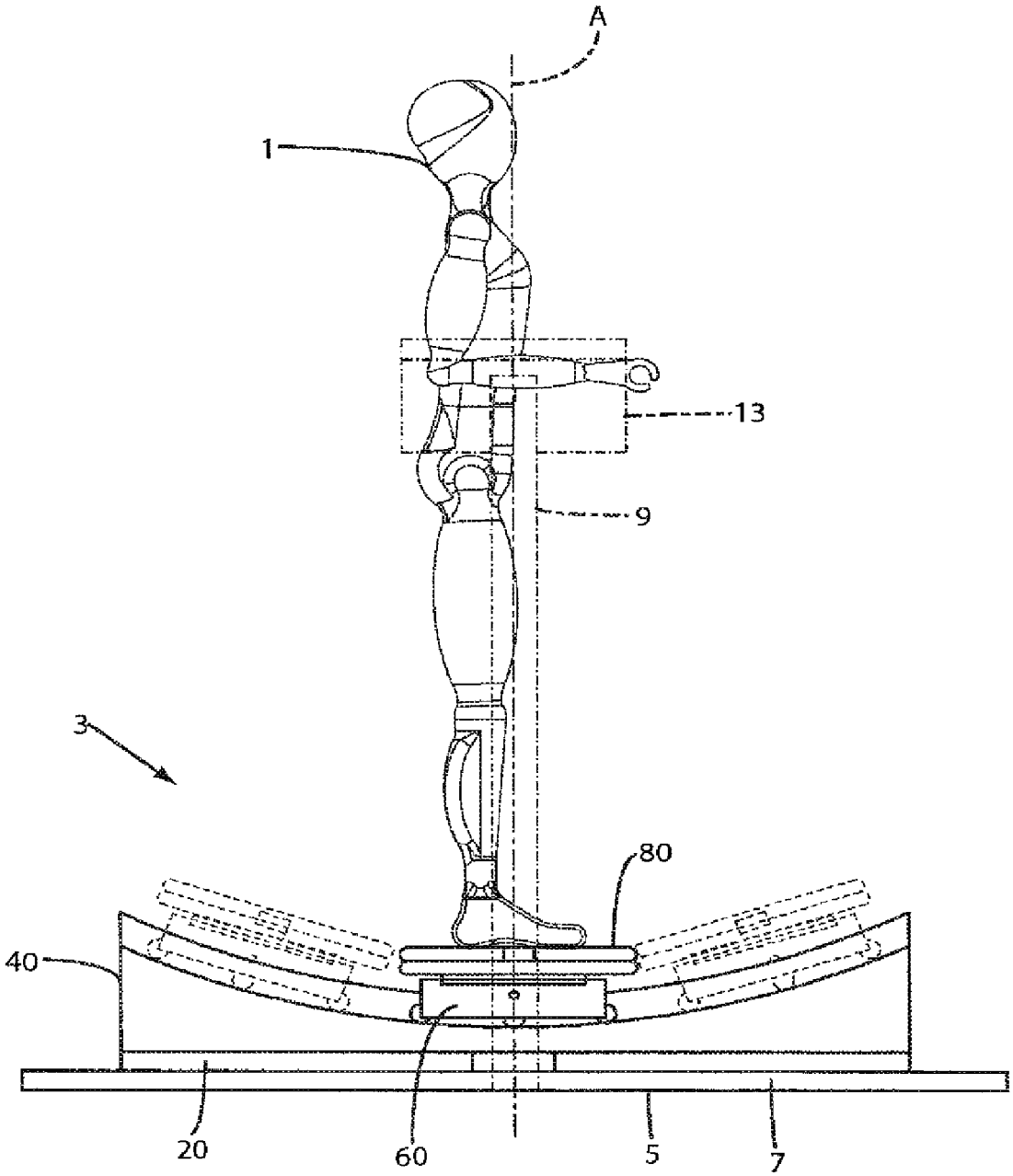
FIG. 2 is a schematic illustration of a side view of the exercise device of FIG. 1 in accordance with an embodiment of the present invention.

For instance, as shown in FIG. 2, by locking the first platform 20 in a first position that positions the track 40 to extend in front of and behind a user 1, and further locking the second platform 80, the user 1 can be provided with a front to back movement along the curved track 40. This exercise is intended to target the anterior abdominal muscles as well as the back muscles (the rectus abdominus muscle which is attached between the pubis and the cartilage of 5th, 6th and 7th ribs having the function of bringing the rib cage and the pelvis toward each other during the forward part of the exercise, and the erector spinae muscles working in the backward part of the movement).

Figure 1A:
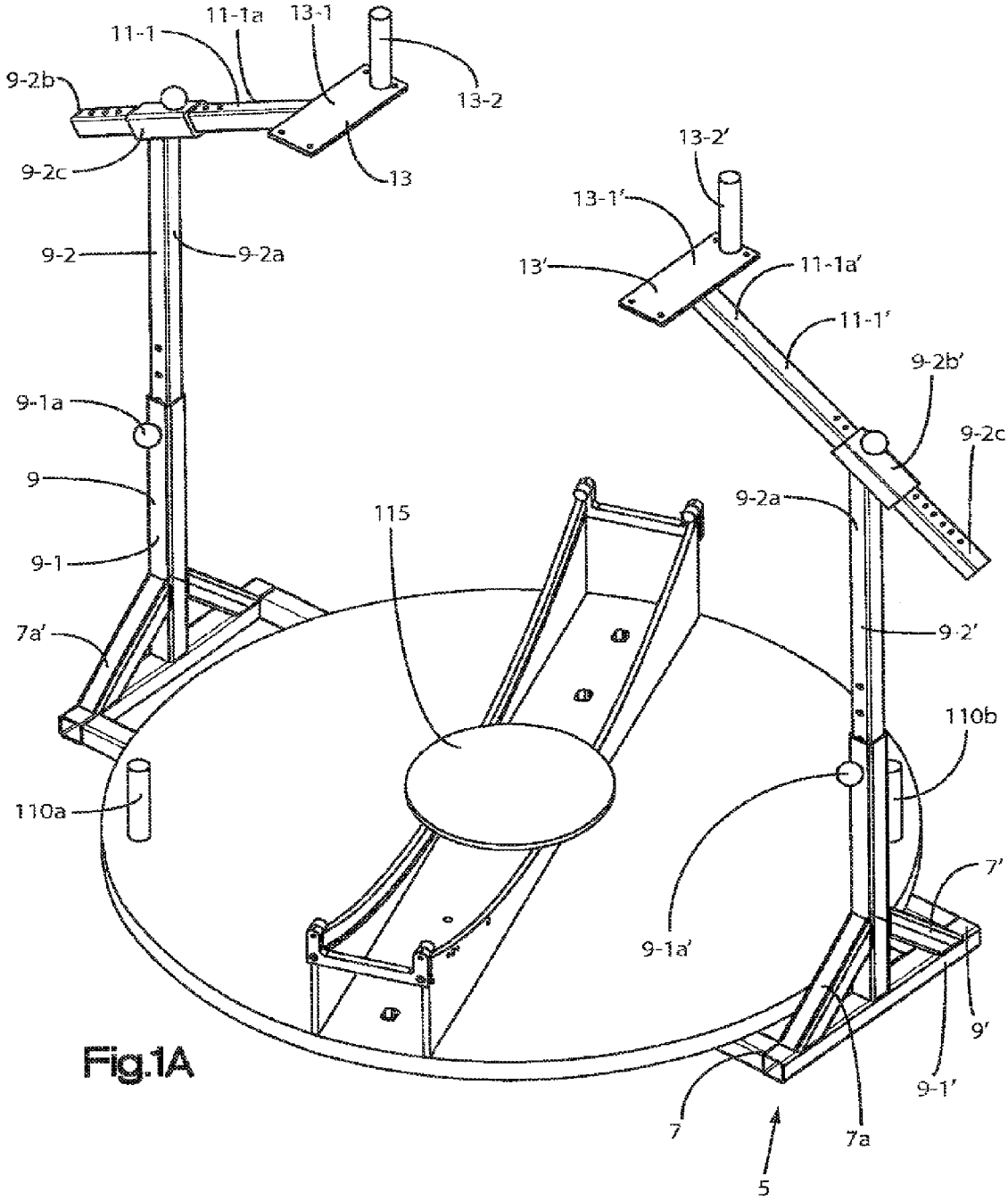
FIGS. 1A and 1B are schematic illustrations of an isometric view of the exercise device of FIG. 1 in accordance with an embodiment of the present invention.

Alternatively, as shown in FIGS. 1 and 1A, by locking the first platform 20 in a second position that positions the track 40 to extend to the left and right of a user 1, and further locking the second platform 80, the user 1 can be provided with a side to side movement along the curved track 40. This exercise is intended to target the lateral part of the abdominal wall, the external oblique, the internal oblique and the transversus abdominus muscles. The external oblique is situated on the lateral and anterior part of the abdomen. It arises from the 5th to 12th ribs. The lower fibers pass vertically downward and are inserted into the anterior half of the outer iliac crest, the middle and upper fibers are directed downward and forward, then become aponeurotic. This aponeurosis formed from fibers from either side decussate at the linea alba. The internal oblique fibers run perpendicular to external oblique muscles. It arises from the thoraco lumbar fascia in the back and anterior two third of the iliac crest and the lateral half of the inguinal ligament. Its fibers run into a superior and medial direction toward the midline and gets attached to the linea alba and the 10th through 12th ribs. External and internal oblique muscles rotate and side bend the trunk. The external oblique of one side acts with the internal oblique of the other side to achieve torsional movement of the trunk.

It is envisioned that the exercise device 3 will include, but not be required to have, at least the two above-described locking positions, but may include a number of intervening locking positions such that the track 40 may be positioned at angles between the front to back and side to side positions to further provide flexibility in the muscle targeting training regimen. It will also be understood by persons of skill in the art that the discussion of what muscles are intended to be targeted by the exercise device 3 is not meant to be limiting and whether such muscles are actually impacted and to what degree depends not only on the operation of the device, but also on proper usage by a user of said device.

Figure 3:
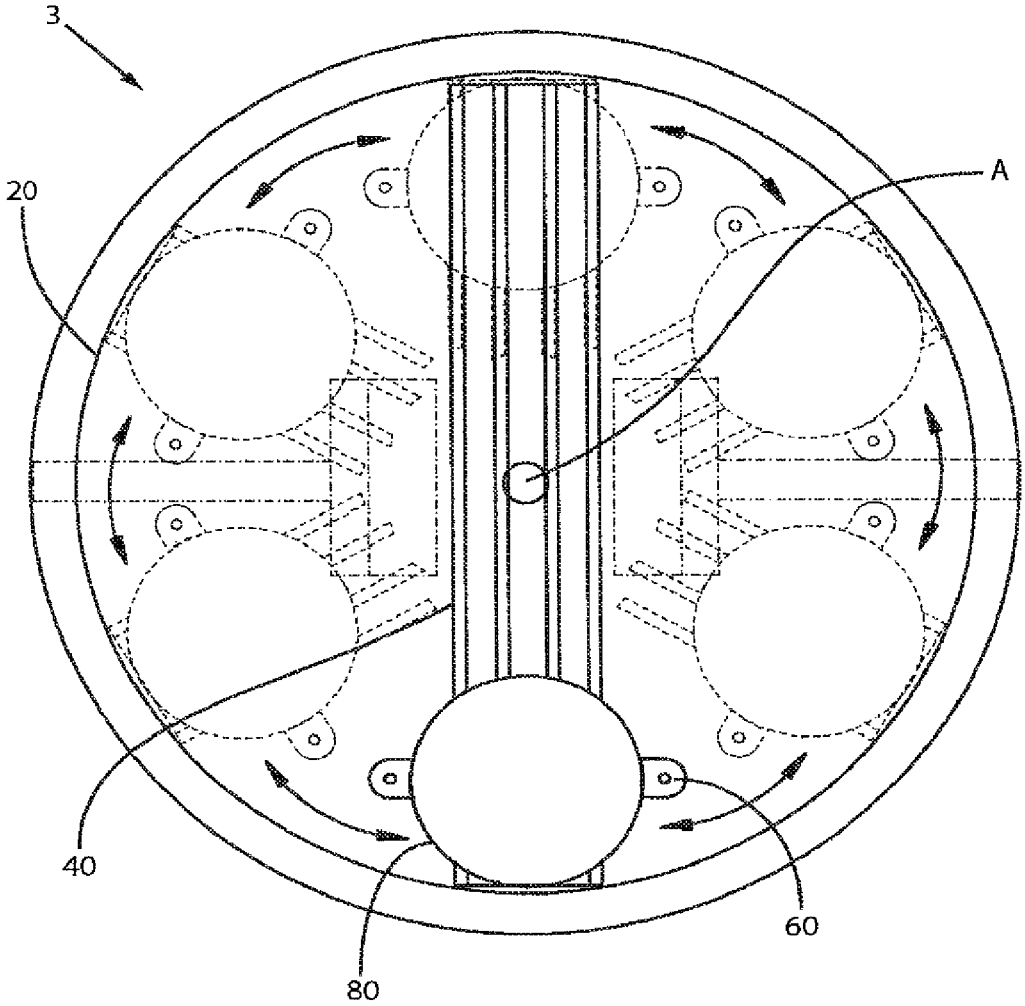
FIG. 3 schematically illustrates a top view of the second platform in a selected position of the track mounted to the first platform in accordance with an embodiment of the present invention.

As depicted in FIG. 3, a rotational range of motion about an axis A passing through the center of the first platform 20 can be achieved by unlocking the first 20 and second 80 platform, and locking the rolling mechanism 60 in a selected position on the track (which includes any of the locking positions on the track 40 away from the center). The user will perform rotational movement using the whole torso muscles in one block around the center of the machine. Further, the first platform can be configured with a resistance mechanism that may include a weight holding device or a mean to resist the twisting of the bearings on which the first platform 20 is mounted, which will increase the intensity of the exercise performed by the torso muscles.

Further, in either of the positions shown in FIGS. 1 and 2, by locking the first platform 20 in one of the locking positions, and further locking the rolling mechanism 60 in a selected position on the track (which includes the center position or any other position on the track 40), and unlocking the second platform 80, a rotational range of motion can be achieved. In this way, for example, a user 1 would twist the core of their bodies such that their lower bodies twisted back and forth (or left and then right, or vice versa). If the rolling mechanism 60 is locked in a position outside of the center, a specific oblique muscle can be further targeted.

A similar rotational motion can be achieved by locking the second platform 80 in one of the locking positions, and further locking the rolling mechanism 60 in a selected position on the track (which includes the center position or any other position on the track 40), and unlocking the first platform 20. This differs from the aforementioned rotation, because, as shown in FIG. 1A, the first platform 20 can be configured with a resistance mechanism 110. The resistance mechanism 110 may include a weight holding device or a means to resist the twisting of the bearings on which the first platform 20 is mounted. Resistance mechanism 110, as shown in FIG. 1A may be formed as a pair of upwardly extending posts 110A and 110B, which are designed and configured to hold one or more platen weights on the surface of the first platform 20. The weights increase the rotational inertia of the first platform 20 making it increasingly more difficult for a user to turn the first platform and thereby increasing the effort necessary to perform the exercise. Of course, one skilled in the art will recognize that the second platform 80 can also be configured to include a resistance mechanism 115, as previously described.

As yet a further alternative, the respective resistance mechanisms of the first and second platforms 20, 80 could be a magnetic or friction based resistance mechanism applied to the rotational motion of the turntables 24, 62 that permit rotation of the first and second platforms 20, 80.

As depicted in FIG. 3, by locking the rolling mechanism 60 in a selected position on the track 40 away from the center, and locking the second platform 80, but unlocking the first platform 20, a rotational range of motion about an axis A passing through the center of the first platform 20 can be achieved.

Figure 1B:
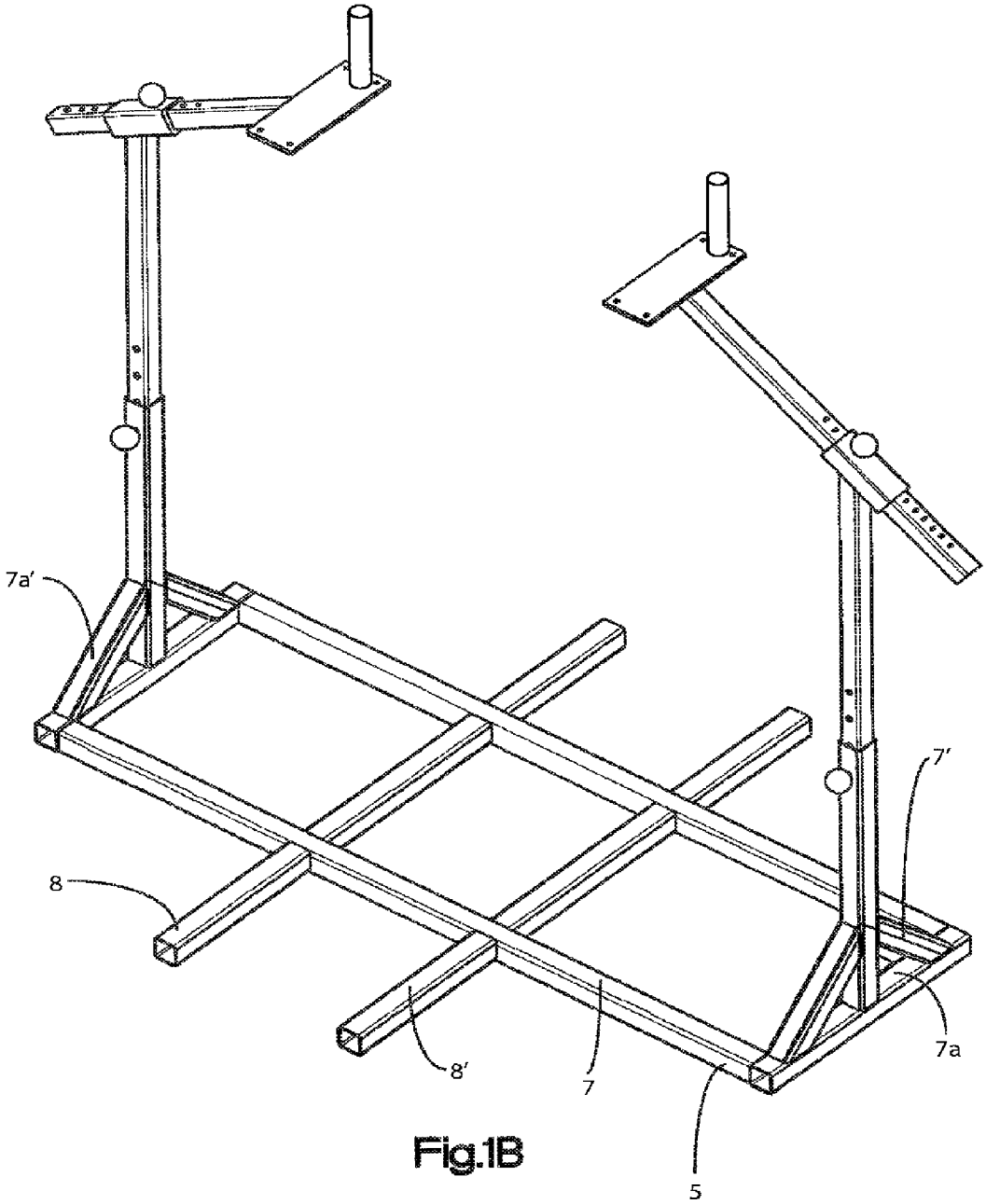
Figure 1C:
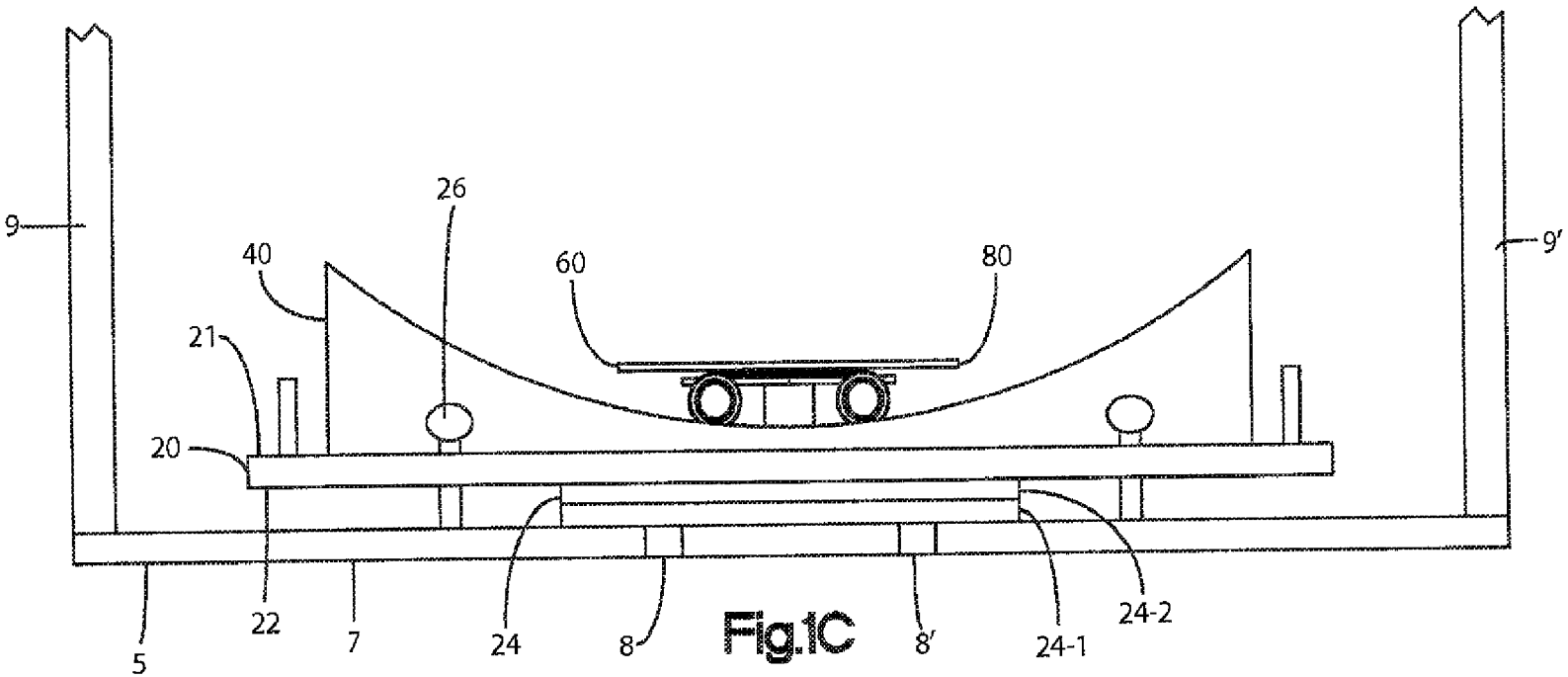
FIGS. 1C-1D are schematics showing various features of the exercise device of FIG. 1 in accordance with an embodiment of the present invention.

With reference again to FIGS. 1 and 2, an exemplary embodiment of an exercise device 3 comprises a base 5, a first selectably rotatable platform 20, a curved track 40 mounted on the first platform 20, a rolling mechanism 60 designed and configured to ride on the curved track 40, and a second selectably rotatable platform 80 mounted to the rolling mechanism 60. In the embodiment shown in FIG. 1, the base frame 5 includes at least one beam 7. In some embodiments of base frame 5, as shown in FIG. 1B, beams 7 and 7' extend substantially parallel to one another and are joined together at each end thereof by braces 7*a* and 7*a*'. By way of non-limiting example, the length of beams 7, 7' is 140 cm (~55 inches) and the length of braces 7*a*, 7*a*' is 20 cm (7.87 inches). In addition, as further shown in FIG. 1B, a pair of cross-beams 8 and 8' may be included to further stabilize the base frame 5 to support the weight and twisting motion of the user above. To keep the cross-beams 8, 8' out of sight, if a circular first platform 20 is used, the length of cross-beams 8, 8' can be approximately 100 cm (39.37 inches). Persons of skill in the art will recognize that the base frame 5 may be constructed in a number of ways designed and configured to adequately support even an extreme weight for a person using the device 3. For example, a larger rectangle shape made of two beams 7, 7' and two braces 7*a*, 7*a*' with one or more optional cross-braces 8, 8' could be used. A generally square or circular shape could be used, as well a triangular shape.

The components of the base frame 5 may be constructed from tubular steel. By way of non-limiting example, the tubular steel is 1.5"×1.5" square tubing. Other dimensions, such as, for example, 2"×2," may also be used as desired to increase the strength and stability of the base frame 5. In such cases, it is understood that persons of skill in the art will recognize that weight may then be a concern. Persons of skill in the art will likewise recognize that other materials providing adequate strength and stability could also be used, such as, for example, carbon fiber products, plastics, other metals, and graphite to name a few. The components may also be seam welded together, or may be fastened in any manner known in the art, such as, for example, through use of glue, screws, rivets. Alternatively, the components may be integrally formed.

With reference again to FIGS. 1, 1A, and 2, first and second posts 9, 9' are each fixed to a respective end of the base frame 5, in some embodiments at the position of the braces 7*a*, 7*a*', and extend upward from the frame 5 in a manner substantially orthogonal to the plane of the frame 5. A top end 9*a*, 9*a*' of each of the first and second posts 9, 9' includes an inwardly extending extension 11, 11', which has an arm rest portion 13, 13' at an end thereof. The extensions 11, 11' each may have a slight incline relative to the first and second posts, such that an angle 15, 15' between the extensions 11, 11' and the posts 9, 9' is obtuse.

In certain embodiments, as shown in FIG. 1A, posts 9, 9' and extensions 11, 11' are constructed of three main parts: a base post section 9-1, 9-1'; an upper post section 9-2, 9-2'; and an extension section 11-1, 11-1'. In these embodiments, base post section 9-1, 9-1' is formed of a hollow tube structure. The cross-section of such tube structure may be generally square in shape, although other shapes may be used. As with base frame 5, 1.5"×1.5" tube steel can be used to form base post section 9-1, 9-1'. The hollow space of base post section 9-1,

9-1' is designed and configured to receive upper post section 9-2, 9-2' in the hollow space, so that upper post section 9-2, 9-2' may slidably move upwards and downwards at the option of the user. In some embodiments, the height of base post section 9-1, 9-1' is approximately 1 meter (3.28 feet).

The upper post section 9-2, 9-2' may be held in place at a selectable height through use of a spring-loaded pin system. As shown in FIG. 1A, upper post section 9-2, 9-2' includes a number of holes 9-2*a*, 9-2*a'* into which a spring loaded pin 9-1*a*, 9-1*a'* positioned near a top end of the base post section 9-1, 9-1' can be inserted to at least temporarily fix the height of upper post section 9-2, 9-2' and thus the height of the arm rest portion 13, 13'. Although use of a spring loaded pin is described herein, as desired a loose pin or other height selection components can be used in place of the spring loaded pin. In some embodiments, by way of example only, the length of upper post section 9-2, 9-2' is approximately 0.75 meters (2.46 feet). Holes 9-2*a*, 9-2*a'* may be spaced about 5 cm (~2 inches) apart and number about twelve (12) to accommodate approximately 60 cm (or 2 feet) of adjustment.

Similarly, the extension section 11-1, 11-1' may be slidably positioned to adjust the height and separation of the arm rests 13, 13' through use of spring-loaded pin system. As shown in FIG. 1A, upper post section 9-2, 9-2' further includes a sleeve 9-2*c*, 9-2*c'* at a top end of the upper post section 9-2, 9-2'. The sleeve 9-2*b*, 9-2*b'* may be positioned at angle 15, 15' to produce the desired incline for extension section 11-1, 11-1', as previously described. Extension section 11-1, 11-1' includes a number of holes 11-1*a*, 11-1*a'* into which a spring loaded pin 9-2*c*, 9-2*c'* positioned on the sleeve 9-2*b*, 9-2*b'* of upper post section 9-2, 9-2' can be inserted to at least temporarily fix the position of extension section 11-1, 11-1' and thus the height and separation of the arm rest portion 13, 13'. Although use of a spring loaded pin is described herein, as desired a loose pin or other height selection components can be used in place of the spring loaded pin. The length of extension sections 11-1, 11-1' may be 65 cm (–26 inches), which enables the extension section 11-1, 11-1' to compress and expand to suit numerous body types and still maintain sufficient tube length within sleeve 9-2*b*, 9-2*b'* for stability. Extension sections 11-1, 11-1' may have a plurality of holes, such as, for example, nine (9) holes, each separated by 5 cm (~2 inches) to permit multiple customization of the position of arm rests 13, 13'.

As further shown in FIG. 1A, arm rest 13, 13' may include a flat portion 13-1, 13-1' that is positioned substantially parallel to the ground and/or the plane of the base frame 5. Arm rest 13, 13' may also include handle 13-2, 13-2' to aid the user in maintaining balance and stability on the device 3.

Referring again to FIGS. 1 and 2, a first selectably rotatable platform 20, which may be circular, or may be other shapes, such as, for example, generally square, rectangular, oblong or elliptical in shape, and has upper and lower surfaces 21, 22, is rotatably mounted to the beam 7 of the base frame 5. The platform 20 may rotate about a first axis A perpendicular to a plane of the beam 7 of the base frame 5. In an embodiment, the connection between the lower surface 22 of the platform 20 and the base frame 5 is made via a turntable 24 (see FIGS. 4A and 4B), which may include two movable sections 24-1, 24-2 (the first 24-1 attached to the base frame 5 and the second 24-2 attached to the lower surface 22 of the platform 20) separated by a low friction surface (not shown), such as may be produced by ball bearings. In some embodiments, platform 20 is approximately 120 cm (~47 inches); however, other dimensions may be used so long as the outer edge of platform 20 clears the first and second posts, 9, 9'. In addition, the size of platform 20 can be dictated by the desired range of motion for travel of the second platform 80 on the curved track 40.

Figure 1D:
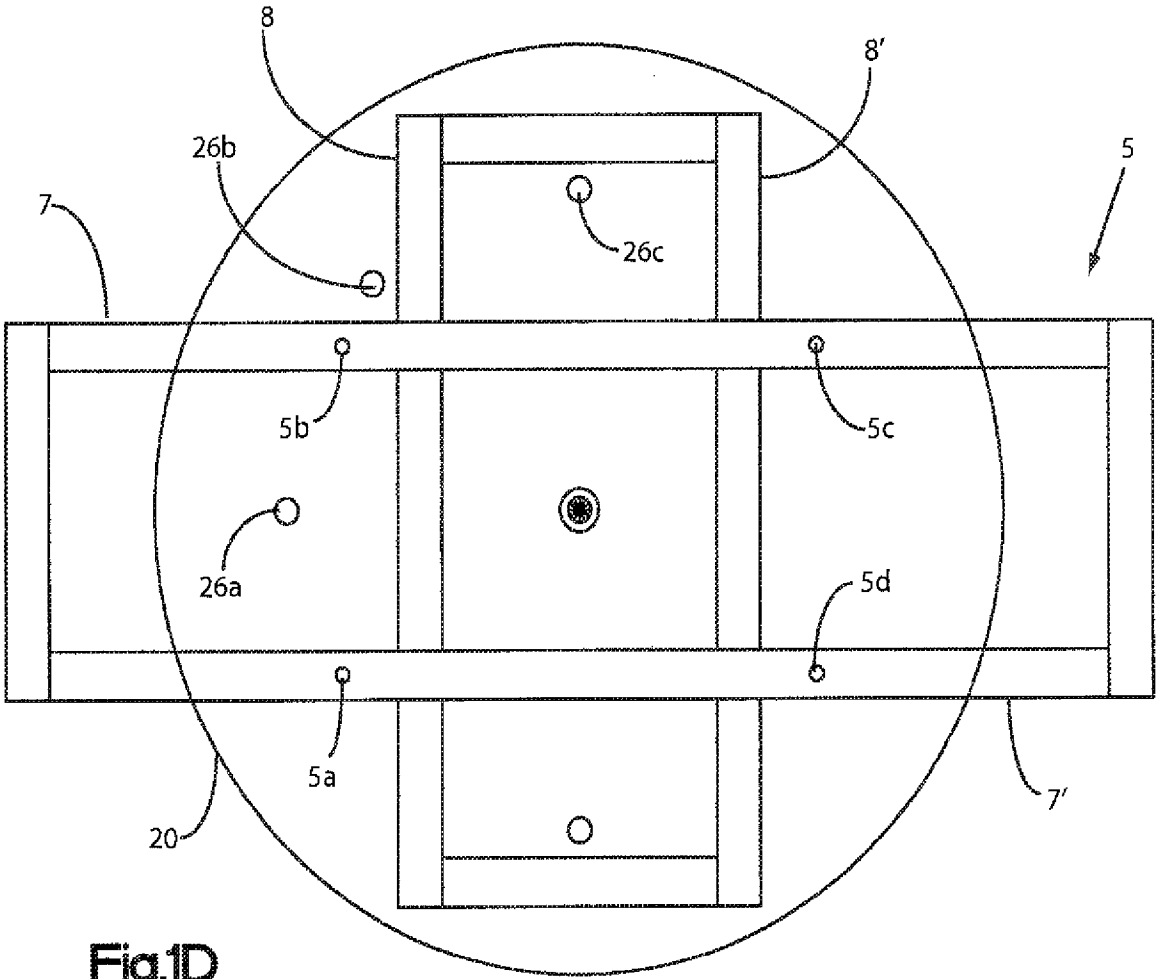

In some embodiments, a first locking device 26 may be included to prevent the platform 20 from rotating on the base frame 5. As shown in FIG. 1D, a series of holes 5*a*-5*d* designed to receive a pin may be formed at various positions on the beams 7 of the base frame 5. Additionally, the platform 20 may include one or more spring-loaded pin mechanisms 26*a-c* positioned to selectably mate with one of the holes 5*a* of the base frame 5 to lock the platform 20 in a desired position. In some embodiments, base frame 5 includes at least two holes to permit the platform 20 to be positioned alternatively as shown in FIGS. 1 and 2. The platform 20 may include at least three (3) pin mechanisms 26*a-c* and base frame 5 may include at least four (4) holes 5*a-d* to accommodate the platform 20 in positions angled in preselected locations, such as, for example, every 45-degrees (i.e., 0°, 45°, 90°, 135°, 180°, 225°, 270°, 315°, and 360°). Persons of skill in the art will recognize that the number of holes and pin mechanisms is a matter of design choice.

A track 40 is mounted to the upper surface 21 of the platform 20. The track 40 generally comprises a pair of curved track portions 41, 42, which extend away from the upper surface 21 of the platform 20 such that the curved surface 41*a*, 42*a* of the track portions 41, 42 faces away from the platform 20. The track portions 41, 42 can be attached to one another by a pair of cross-braces 43, 43' mounted at each end of the respective track portions 41, 42. In some embodiments, an inner surface 41*b*, 42*b* of each track portion 41, 42 includes a channel 41*b*-1, 42*b*-1 that substantially follows the curve 41*a*, 42*a* of the track portions. The channels 41*b*-1, 42*b*-1 may terminate at a distance away from the end of the track portions 41, 42 to limit the range of motion within the track portion 41, 42, as will be described in further detail below.

Figure 4A:
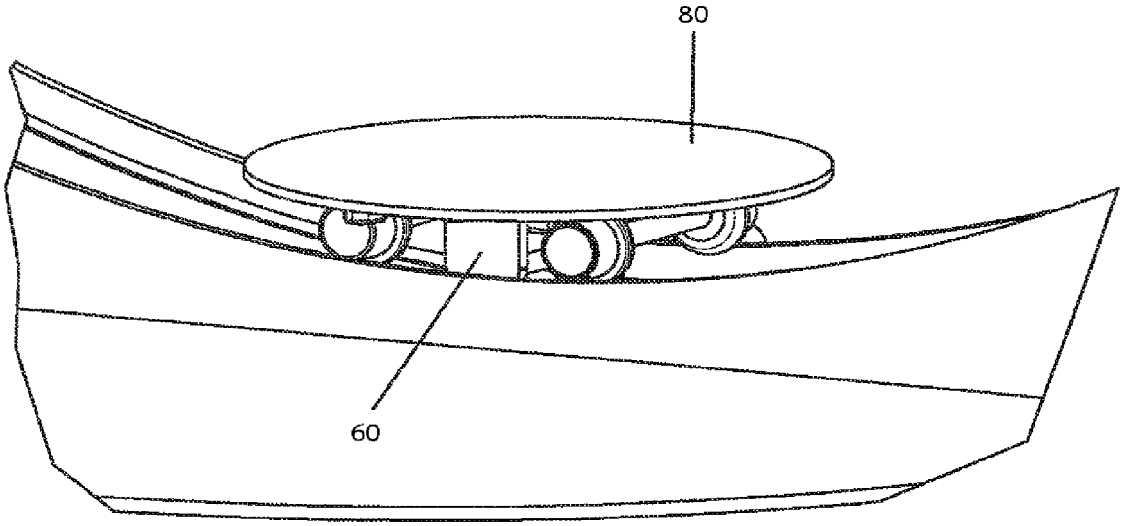
FIGS. 4A and 4B schematically illustrate views of a rolling mechanism and second platform positioned on the track mounted to the first platform in accordance with an embodiment of the present invention.
Figure 4B:
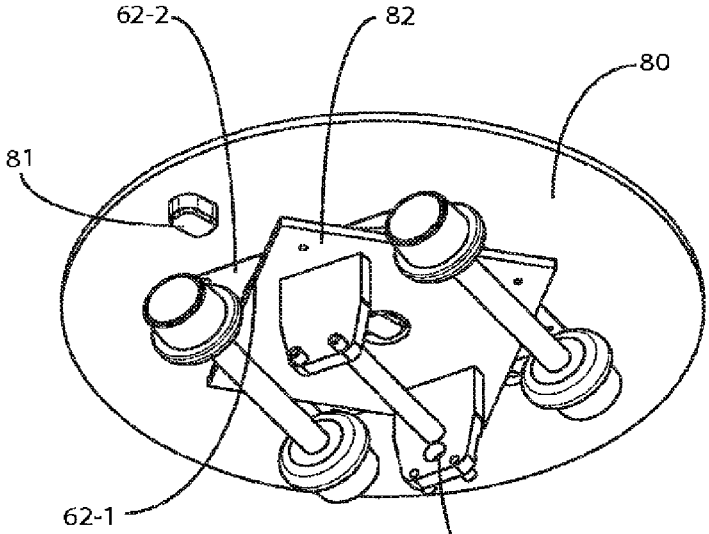

With reference again to FIGS. 1 and 2 and also to FIGS. 4A and 4B, a second selectably rotatable platform 80 is mounted to a rolling mechanism 60. In an embodiment, the connection between the bottom surface 81 of the second platform 80 and the rolling mechanism 60 is made via a turntable 62, which may include two movable sections (the first 62-1 attached to the rolling mechanism 60 and the second 62-2 attached to the bottom surface 81 of the second platform 80) separated by a low friction surface, such as may be produced by ball bearings. A second locking device 82 may be included to prevent the second platform 80 from rotating relative to the rolling mechanism 60. As noted above, the various locking combinations of first platform 20 and second platform 80 provide various exercise options.

Figure 5:
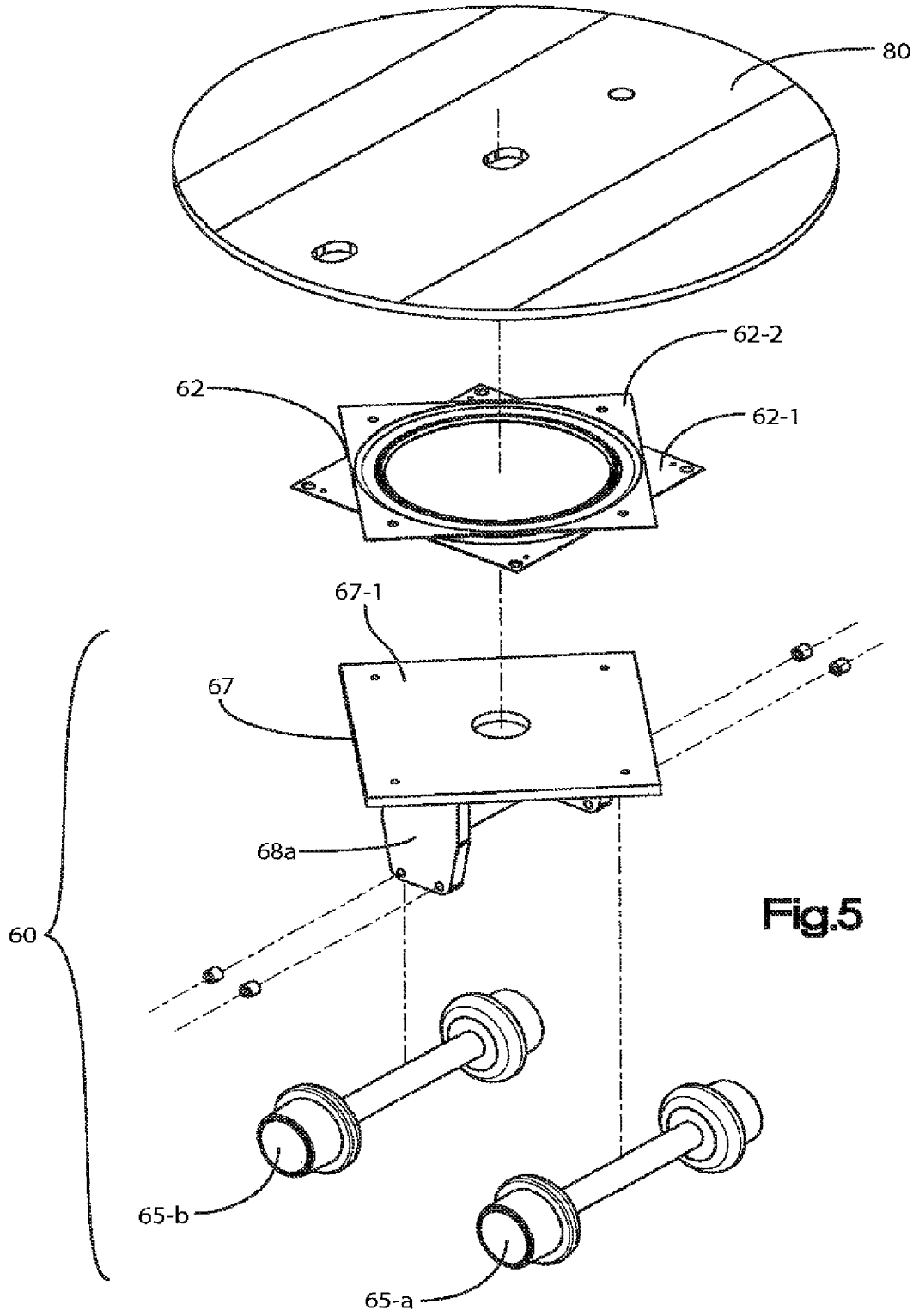
FIG. 5 schematically illustrates an exploded view of the rolling mechanism and second platform in accordance with an embodiment of the present invention.

With reference to FIG. 5, an exploded view of the platform 80 and rolling mechanism 60 are shown. The rolling mechanism 60 generally comprises two pairs of wheels 65*a*, 65*b* each mounted on an axle 66*a*, 66*b*, which is in turn mounted to a frame 67 of the rolling mechanism 60. The wheels 65*a*, 65*b* are spaced such that, when the rolling mechanism 60 is positioned on the curved surfaces 41*a*, 42*a* of the track portion 41, 42, the wheels 65*a*, 65*b* will ride on the curved surfaces 41*a*, 42*a*. The upper surface 67-1 of the frame 67 of the rolling mechanism 60 is mounted to the turntable 62 that mounts to the second platform 80 for providing the rotational functionality of the second platform 80. A pair of downwardly extending fins 68*a*, 68*b* extend from a bottom surface 67-2 of the frame 67 of the rolling mechanism 60, and may be positioned to extend downward and into the space between the inside walls 41*b*, 42*b* of the track portions 41, 42 when the rolling mechanism 60 is positioned on the track 40.

Figure 6:
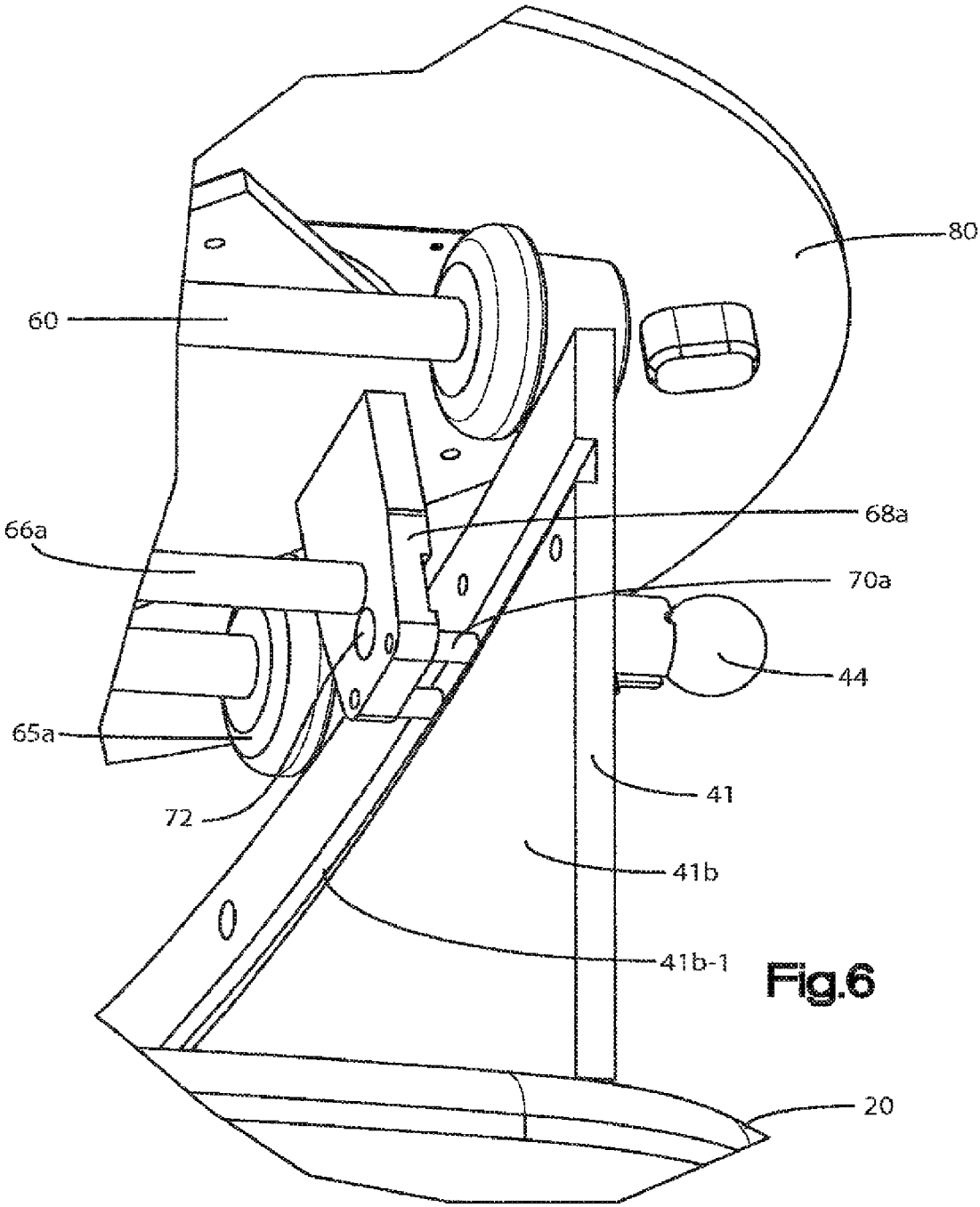
FIG. 6 depicts an underside view of the rolling mechanism slidably engaged with the curved track of the first platform in accordance with an embodiment of the present invention.

With further reference to FIG. 6, in one exemplary embodiment, at least one channel engagement portion 70*a*, 70*b* extends from an outside face of each of the fins 68*a*, 68*b*. Each channel engagement portion 70*a*, 70*b* can be sized and configured to slidably engage the channels 41*b*-1, 42*b*-1 of the respective track portions 41, 42, such that when the rolling mechanism 60 is riding on the curved surfaces 41*a*, 42*a* of the track portions 41, 42 the channel engagement portions 70*a*, 70*b* will move within the channels 41*b*-1, 42*b*-1 to provide lateral support to the rolling mechanism 60. Multiple channel engagement portions 70*a*, 70*b* may be provided on the fins 68*a*, 68*b* to increase lateral support and prevent the rolling mechanism 60 from falling off of the track 40.

In an embodiment, a third locking device can lock the rolling mechanism, and thus the second platform, in a specified position on the track. As with the other locking devices this feature enables various customized exercises to be performed as further detailed above. As further shown in FIGS. 6 and 7, the pair of downwardly extending fins 68*a*, 68*b* extending from a bottom surface 67-2 of the frame 67 of the rolling mechanism 60 each may include a pin receiving hole 72, which is designed and configured to receive a spring mounted pin 44 fixed to at least one of the outer ends of at least one of the curved track portions 41, 42. The spring mounted pin 44 may be designed to selectably extend through one of the curved track portions 41, 42, so that it can engage the pin receiving hole 72 and fix the rolling mechanism 60, and thus the second platform 80 in a desired position on the curved track 41, 42. It will be understood by persons of skill in the art that more than one spring mounted pin 44 may be fixed on the curved track 41, 42 so as to permit the rolling mechanism 60 to be selectably position in various positions away from the center of the curved track 41, 42 to achieve various selectable training positions.

Figure 7:
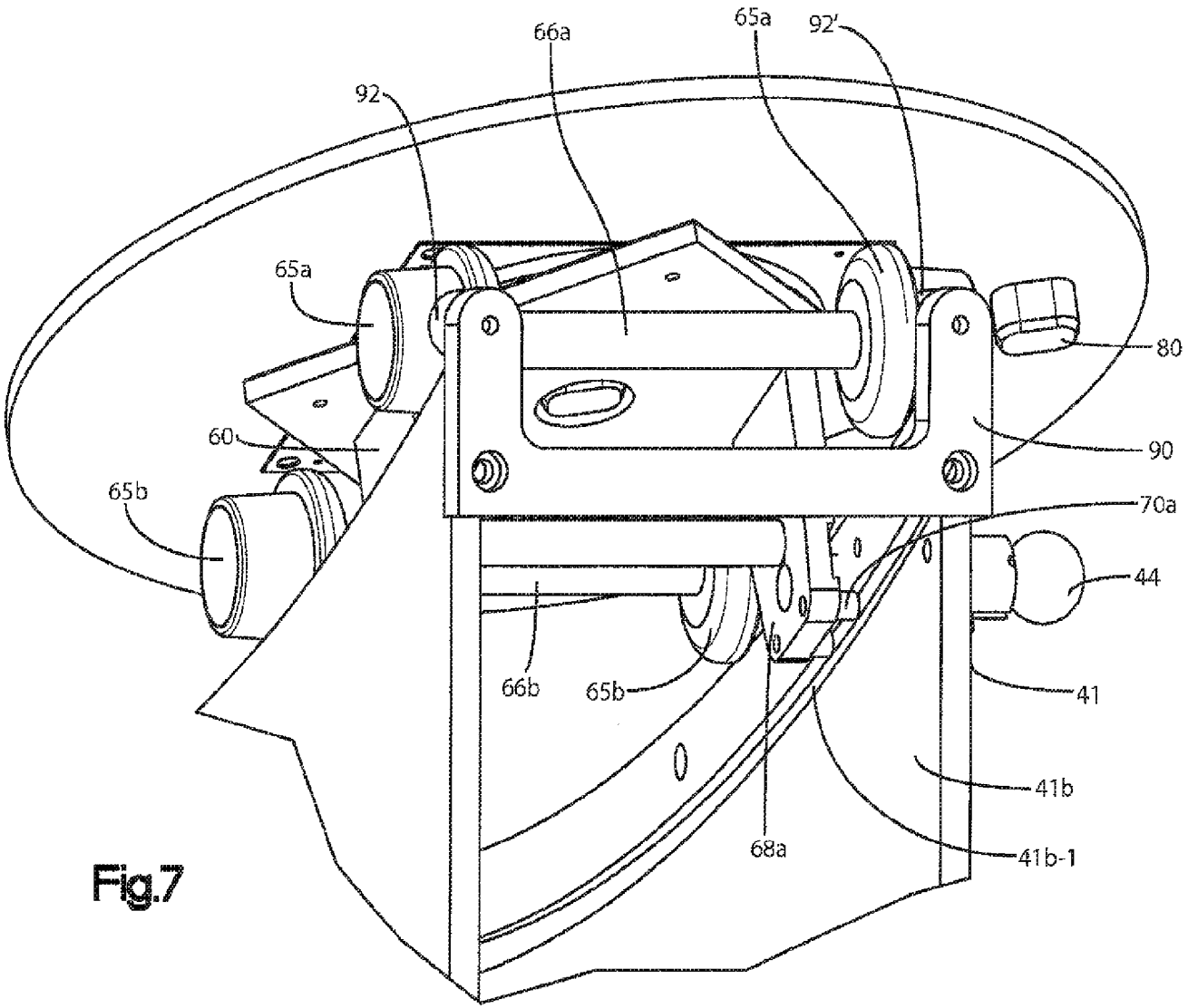
FIG. 7 depicts an underside view of the rolling mechanism in a lock position within the curved track of the first platform in accordance with an embodiment of the present invention.

In addition, as shown in FIGS. 6 and 7, an end plate 90, 90' is fixed to each end of the curved track 41, 42. The end plates 90, 90' may include a pair of rubber bumpers or stoppers 92, 92' facing inwardly towards a center of the exercise device 3 and aligned with the curved surfaces 41*a*, 42*a* of the track portions 41, 42. The function of the bumpers 92, 92' is to provide a backstop for the rolling mechanism 60 so that the second platform 80 cannot be overextended beyond the end of the curved track 41, 42. In lieu of a pair of bumpers 92, 92', one large bumper may be used.

Figure 8:
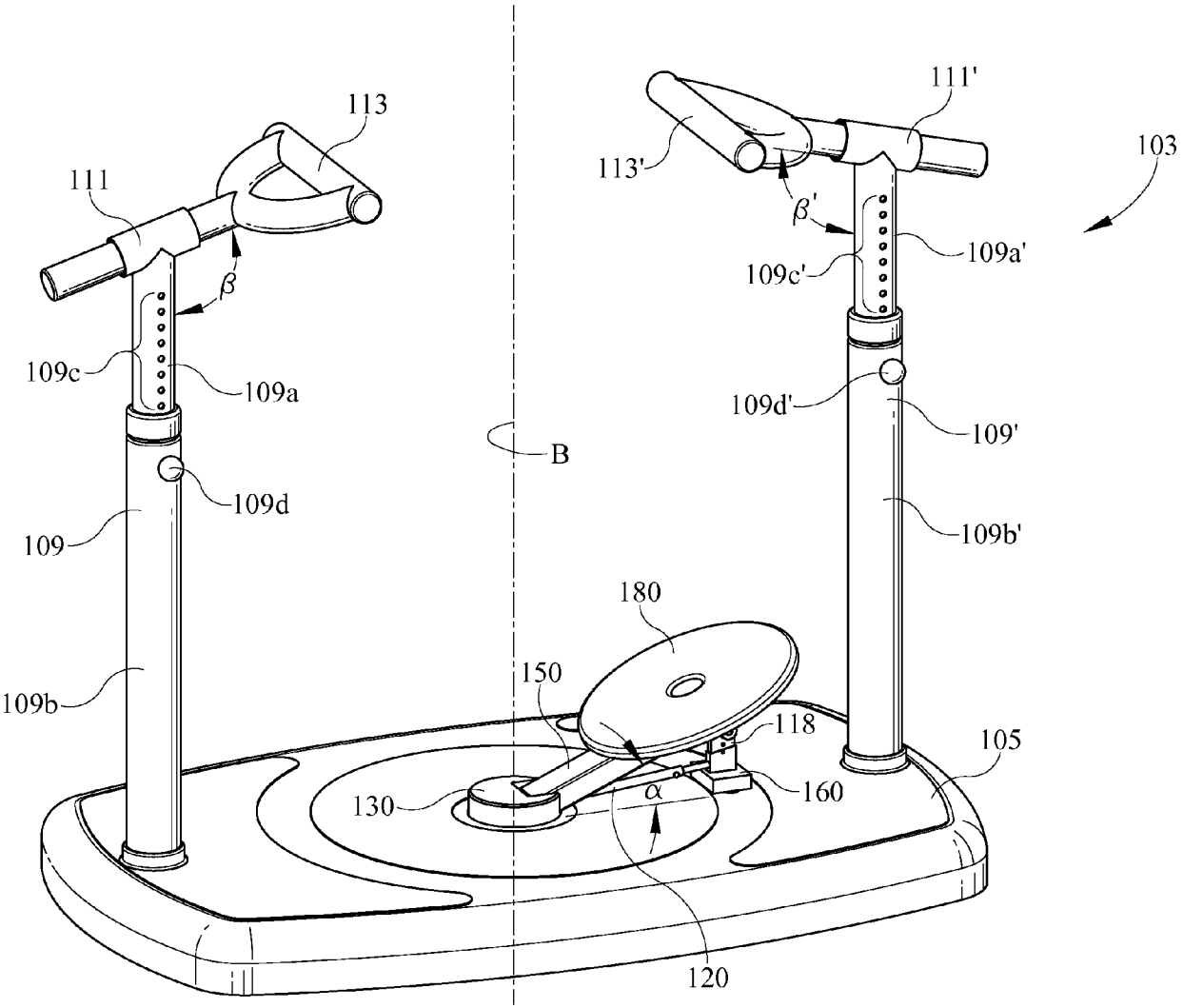
FIG. 8 is a perspective view of an exercise device in accordance with an embodiment of the present invention.
Figure 9:
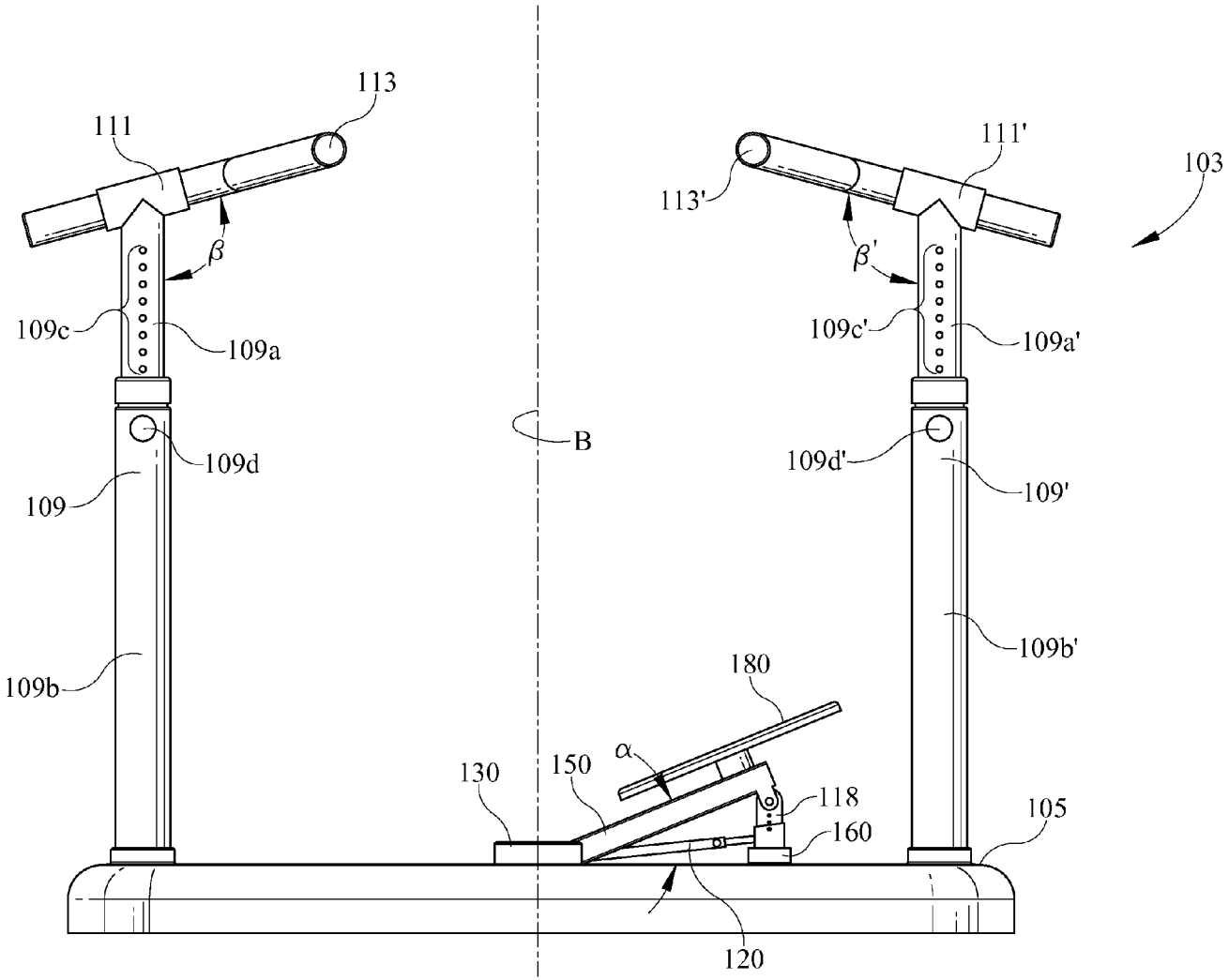
FIG. 9 is a front view of the exercise device of FIG. 8 in accordance with an embodiment of the present invention.

Turning to FIGS. 8 and 9, in another embodiment, an exercise device 103 includes a rotatable platform 180 mounted on an arm portion 150. The arm portion 150 is rotatably connected to and extends from a base frame 105 to form an angle α, and an axis B passes through a center 130 of the base frame 105. The user can perform a revolving range of motion around the axis B using the whole torso muscles in one block around the center 130 of the base frame 105. In addition, the arm portion can be configured with a resistance mechanism that may include a weight holding device or a means to resist the twisting of bearings on which the arm portion 150 is mounted, which will increase the intensity of the exercise performed by the torso muscles.

The connection between the rotatable platform 180 and the arm portion 150 may be adjustable so that the platform 180 can be mounted on the arm portion 150 at a plurality of different distances from the center 130 of the base frame 105. By adjusting the position of the platform 180, the user can adjust the intensity and difficulty of the exercise performed by the torso muscles. For example, when the user's feet are placed on the platform 180, the user's feet may be located at variable distances from the center of the user's body while the position of the user's spine is maintained at the center 130 of the base frame 105. The user can achieve the variable positions, which correspond to variable intensities and difficulties of exercise, by tilting the pelvis.

The arm portion 150 may also be adjustable so that it can form a plurality of different angles with the base frame 105, such as, for example, the angle α. By adjusting the angle that the arm portion 150 forms with the base frame 105, the user can perform a variety of different difficulties and intensities of exercise with the torso muscles. The user can achieve the variable difficulties and intensities of exercise by tilting the pelvis.

Referring again to FIGS. 8 and 9, some embodiments of the exercise device 103 include the base frame 105, the arm portion 150 connected to the base frame 105 and the rotatable platform 180 mounted on the arm portion 150. The base frame 105 may be any of a variety of shapes, such as, for example, generally rectangular, square, circular or triangular in shape. The components of the base frame 105 may be constructed from tubular steel. By way of non-limiting example, the tubular steel may be 1.5"×1.5" square tubing. Other dimensions, such as, for example, 2"×2," may also be used as desired to increase the strength and stability of the base frame 105. In such cases, it is understood that persons of skill in the art will recognize that weight may then be a concern. Persons of skill in the art will likewise recognize that other materials providing adequate strength and stability could also be used, such as, for example, carbon fiber products, plastics, other metals, and graphite to name a few. The components may be seam welded together, or may be fastened in any manner known in the art, such as, for example, through the use of glue, screws or rivets. Alternatively, the components may be integrally formed.

First and second posts 109, 109' may each be fixed to a respective end of the base frame 105 and extend upward from the frame 105 in a manner substantially orthogonal to the plane of the frame 105. First and second posts 109, 109' may each include an inwardly extending extension 111, 111', which has a handle portion 113, 113' at an end thereof. The extensions 111, 111' each may have a slight incline relative to the first and second posts, such that an angle β, β' between the extensions 111, 111' and the posts 109, 109' is obtuse.

First and second posts 109, 109' may also each include an upper post section 109*a*, 109*a'* and a lower post section 109*b*, 109*b'*, which may be formed of a hollow tube structure. The cross-section of such tube structure may be generally circular or square in shape, although other shapes may be used. As with base frame 105, 1.5"×1.5" tube steel can be used to form the lower post sections, for example. The hollow space of lower post section 109*b*, 109*b'* is designed and configured to receive upper post section 109*a*, 109*a'* in the hollow space, so that upper post section 109*a*, 109*a'* may slidably move upwards and downwards at the option of the user.

The upper post section 109*a*, 109*a'* may be held in place at a selectable height through use of a spring-loaded pin system. Upper post section 109*a*, 109*a'* may include a number of holes 109*c*, 109*c'* into which a spring loaded pin 109*d*, 109*d'* positioned near a top end of the lower post section 109*b*, 109*b'* can be inserted to at least temporarily fix the height of upper post section 109*a*, 109*a'* and thus the height of the handle portion 113, 113'. Although use of a spring loaded pin is described herein, as desired a loose pin or other height selection components can be used in place of the spring loaded pin. Similarly, the extension section 111, 111' may be slidably positioned to adjust the height and separation of the handles 113, 113' through the use of, for example, a spring-loaded pin system, a loose pin system or other height selection system.

Figure 10:
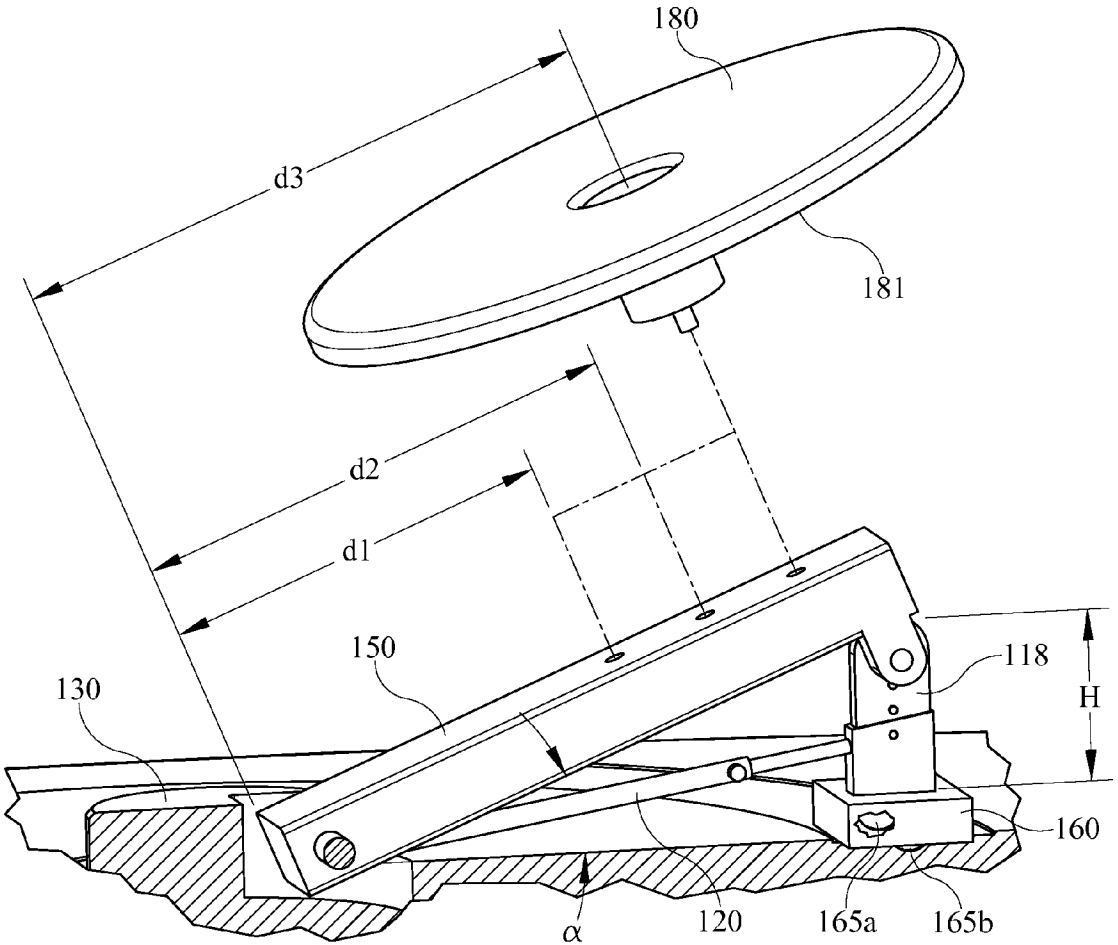
FIG. 10 is a front view of a rotatable platform and an arm portion of an exercise device in accordance with an embodiment of the present invention.
Figure 11:
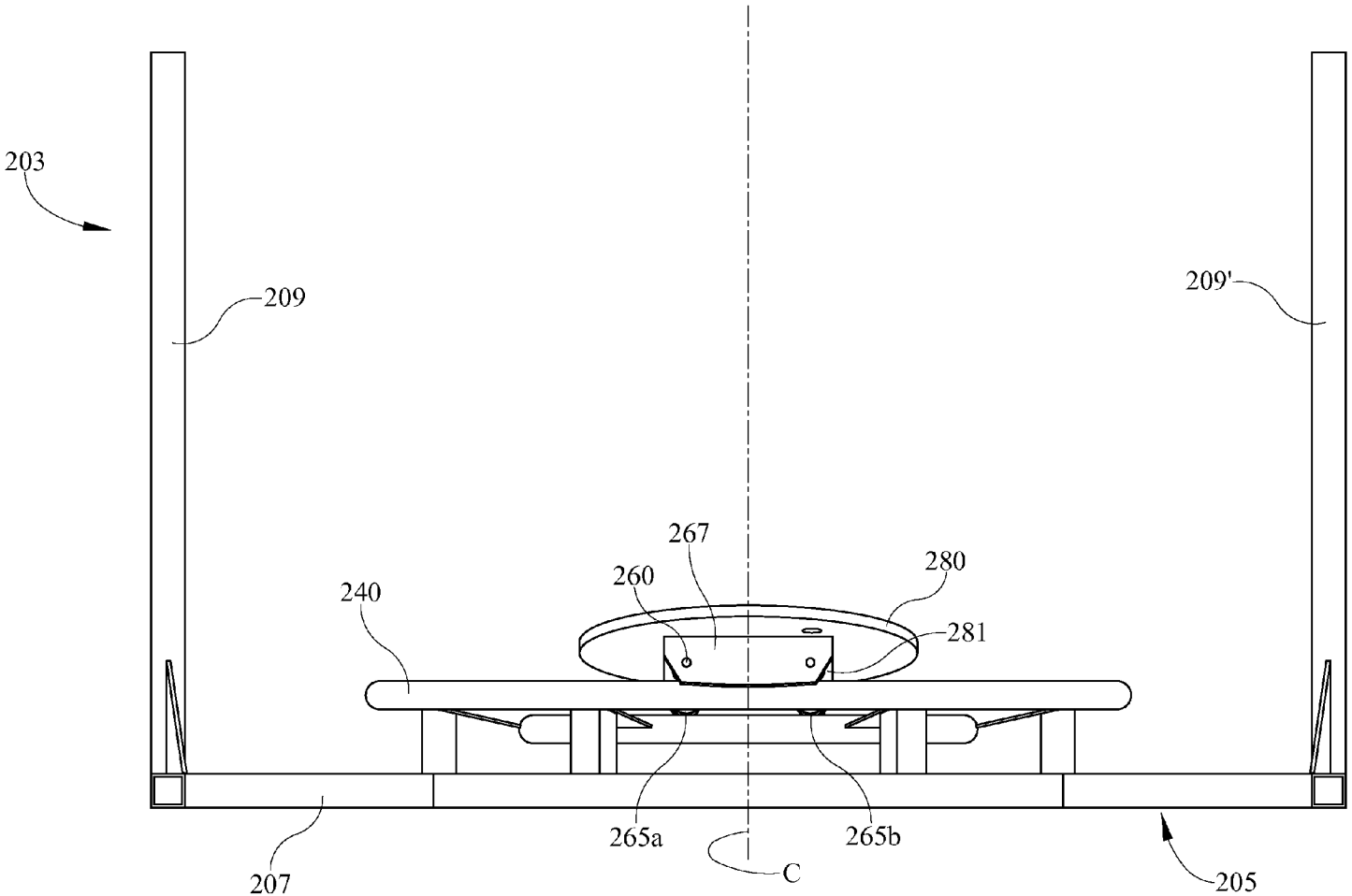
FIG. 11 is a front view of an exercise device in accordance with an embodiment of the present invention.
Figure 12:
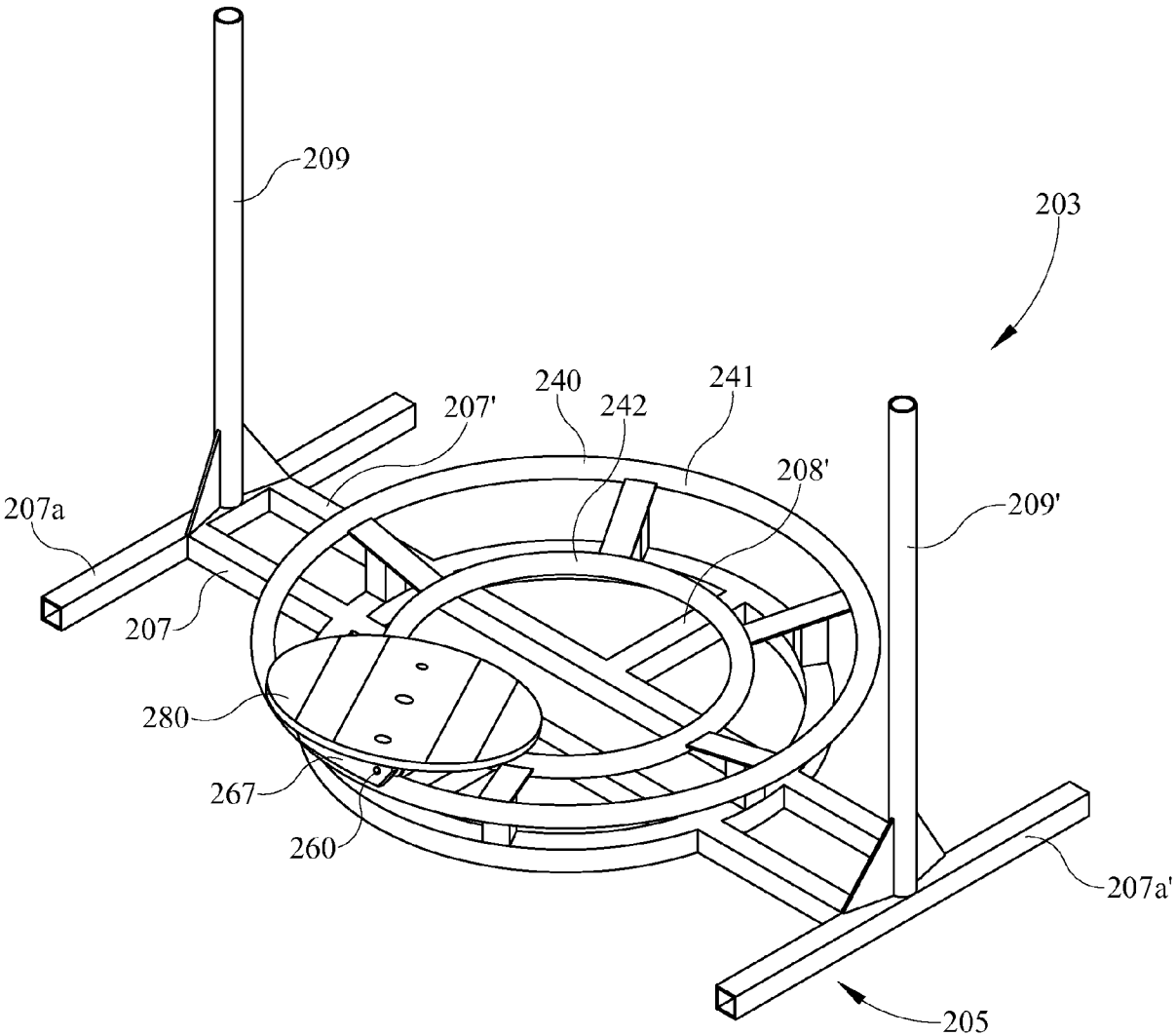
FIG. 12 is a perspective view of the exercise device of FIG. 11 in accordance with an embodiment of the present invention.
Figure 13:
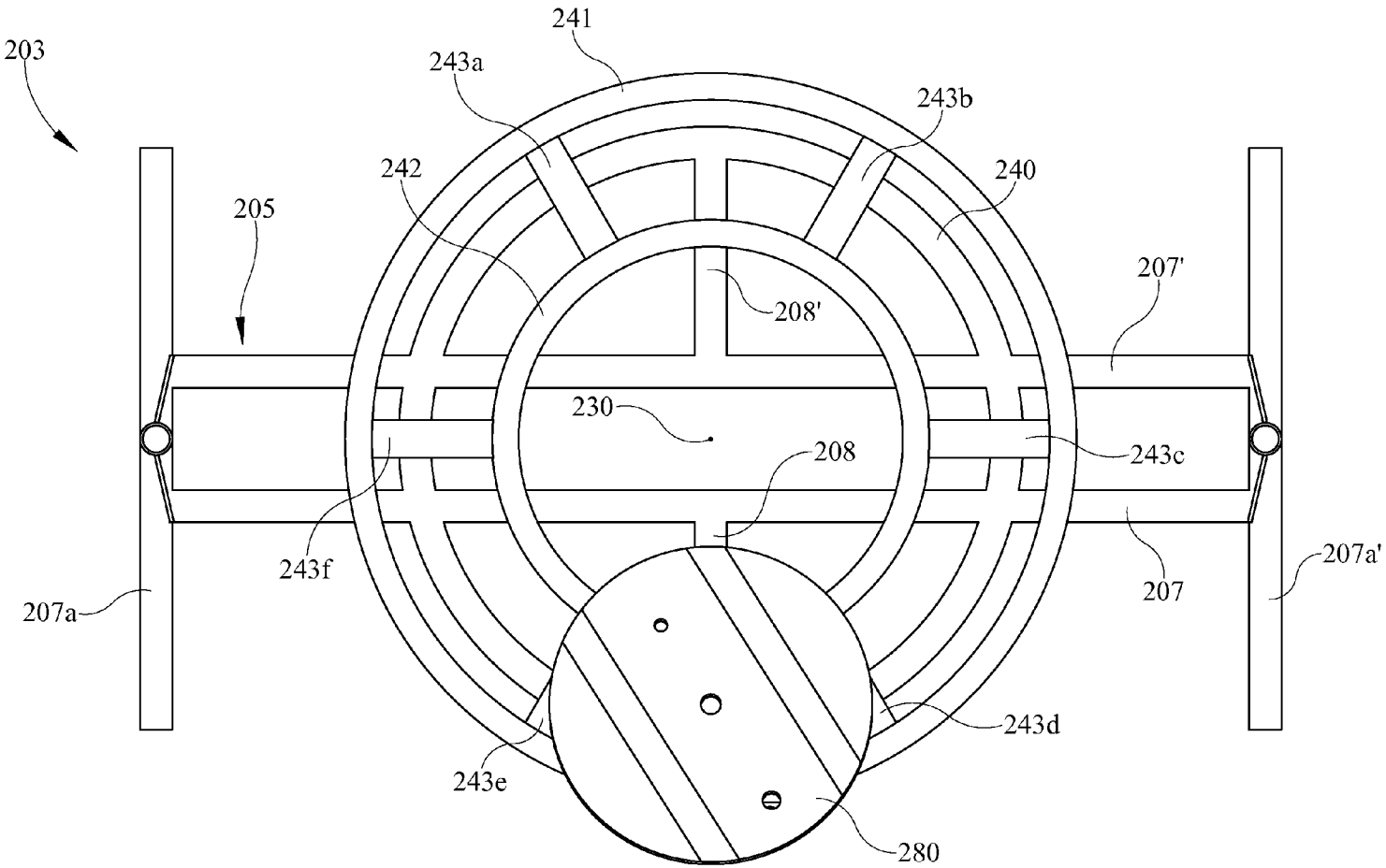
FIG. 13 is a top view of the exercise device of FIG. 11 in accordance with an embodiment of the present invention.
Figure 14:
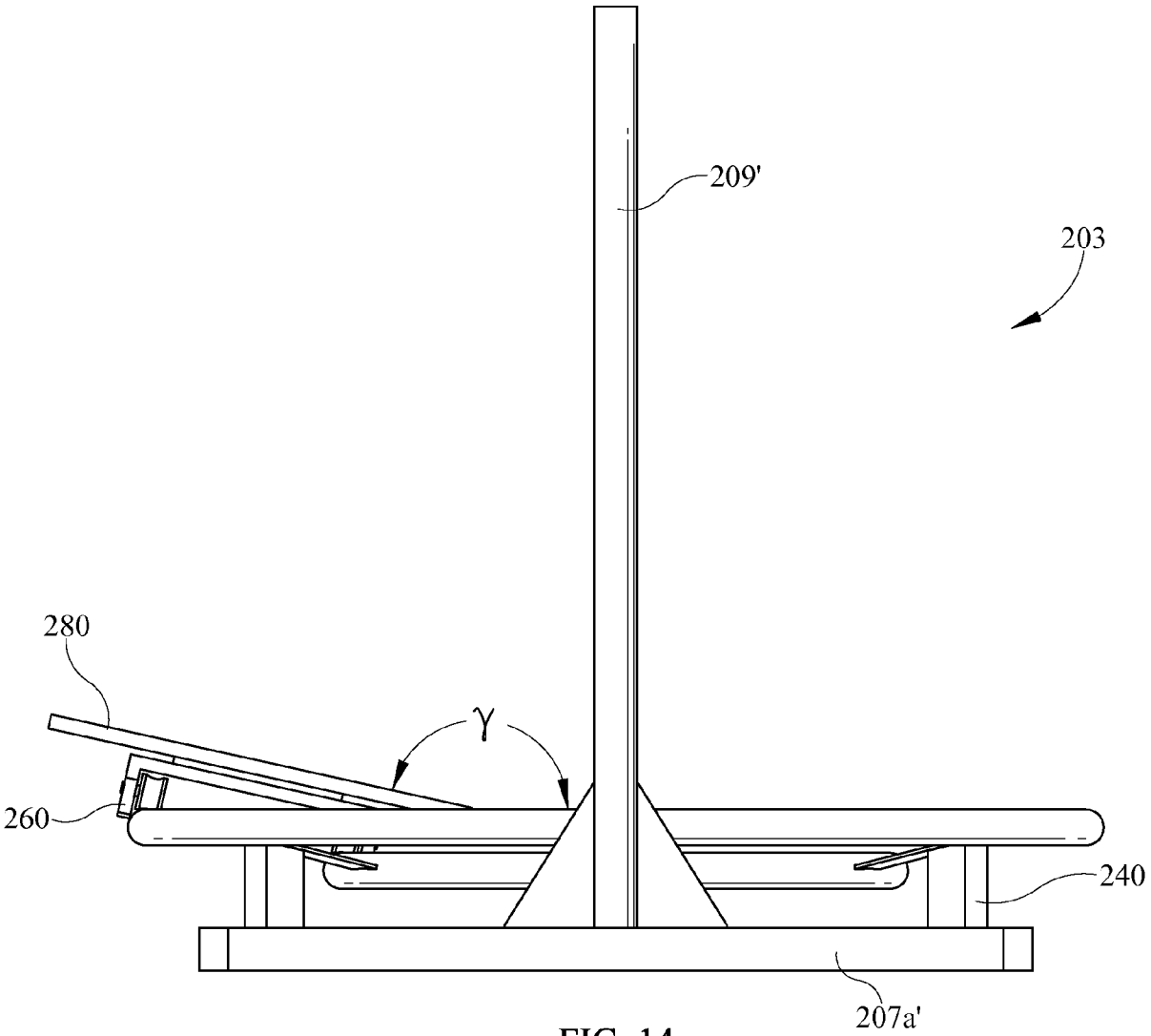
FIG. 14 is a side view of the exercise device of FIG. 11 in accordance with an embodiment of the present invention.

Referring to FIG. 10, the arm portion 150 is rotatably connected to and extends from the base frame 105 to form the angle α with the base frame 105. The arm portion 150 may be connected to substantially the center 130 of the base frame 105 and may rotate about the axis B, which is perpendicular to the plane of the base frame 105. The connection between the arm portion 150 and the base frame 105 may include ball bearings.

The arm portion 150 may be formed of a hollow tube structure. The cross-section of such tube structure may be generally circular or square in shape, although other shapes may be used. 1.5"×1.5" tube steel can be used to form the arm portion 150, for example. Other dimensions, such as, for example, 2"×2," may also be used as desired to increase the strength and stability of the arm portion 150. In such cases, it is understood that persons of skill in the art will recognize that weight may then be a concern. Persons of skill in the art will likewise recognize that other materials providing adequate strength and stability could also be used, such as, for example, carbon fiber products, plastics, other metals, and graphite to name a few.

The arm portion 150 can be configured with a resistance mechanism that may include a weight holding device or a means to resist the twisting of bearings on which the arm portion 150 is mounted. As yet a further alternative, the resistance mechanism of the arm portion 150 could be a magnetic or friction based resistance mechanism applied to the rotational motion of components that permit rotation of the arm portion 150.

Rotatably mounted on the arm portion 150 is the platform 180, which may be any of a variety of shapes, such as, for example, generally circular, square, rectangular, oblong or elliptical in shape. The platform 180 may rotate in a plane that forms the angle α with the plane of the base frame 105 and may revolve around the axis B. The connection between a bottom surface 181 of the platform 180 and the arm portion 150 may include ball bearings. In addition, the platform 180 may be located on the arm portion 150 at a plurality of different distances from the center 130 of the base frame 105, such as, for example, distances $d_1$, $d_2$ and $d_3$. The platform 180 may be held in place at a selectable position through the use of, for example, a spring-loaded pin system, a loose pin system or other position selection system.

The rotatable platform 180 may also be configured with a resistance mechanism that includes a weight holding device or a means to resist the twisting of bearings on which the rotatable platform 180 is mounted. Such a resistance mechanism may be formed as a pair of upwardly extending posts, which are designed and configured to hold one or more platen weights on the surface of the platform 180, for example. The weights increase the rotational inertia of the platform 180 making it increasingly more difficult for a user to turn the platform and thereby increasing the effort necessary to perform the exercise. As yet a further alternative, the resistance mechanism of the rotatable platform 180 could be a magnetic or friction based resistance mechanism applied to the rotational motion of components (such as turntables, for example) that permit rotation of the rotatable platform 180.

The exercise device 103 may also include a pillar 118, extending substantially orthogonally from the base frame 105 to the arm portion 150, to further stabilize the arm portion 150. In some embodiments, the pillar 118 may have an adjustable height H, the adjustment of height H corresponding to the adjustment of the angle α between the arm portion 150 and the base 105. Pivot shafts may also be attached to ends of the arm portion 150 to facilitate the adjustment of the arm portion 150 during the adjustment of the height H and the angle α.

The pillar 118 may be formed of a hollow tube structure. The cross-section of such tube structure may be generally circular or square in shape, although other shapes may be used. 1.5"×1.5" tube steel can be used to form the pillar 118, for example. Other dimensions, such as, for example, 2"×2," may also be used as desired to increase the strength and stability of the pillar 118. In such cases, it is understood that persons of skill in the art will recognize that weight may then be a concern. Persons of skill in the art will likewise recognize that other materials providing adequate strength and stability could also be used, such as, for example, carbon fiber products, plastics, other metals, and graphite to name a few.

The pillar 118 may be held in place at a selectable height through the use of, for example, a spring-loaded pin system, a loose pin system or other height selection system. A telescoping brace 120 may also provide support between the arm portion 150 and the pillar 118. In addition, wheels 165*a* and 165*b* may be mounted on axles (not shown) connected to the pillar 118 to facilitate movement of the pillar 118 around the axis B.

As shown in FIG. 11-14, in another embodiment, an exercise device 203 includes a rotatable platform 280 that rides on a rolling mechanism 260. The rolling mechanism 260 rides on a substantially enclosed track 240 mounted on a base frame 205. An axis C passes through a center 230 of the base frame 205, and the user can perform a revolving range of motion around the axis C using the whole torso muscles in one block around the center 230 of the base frame 205.

The base frame 205 may include at least one beam 207. Beams 207 and 207' may extend substantially parallel to one another and may be joined together at each end thereof by braces 207*a* and 207*a*'. In addition, a pair of cross-beams 208 and 208' may extend from the beams 207, 207' to support the track 240. Persons of skill in the art will recognize that the base frame 205 may be constructed in a number of ways designed and configured to adequately support even an extreme weight for a person using the device 203. For example, a larger rectangle shape made of two beams 207, 207' and two braces 207*a*, 207*a*' with one or more optional cross-beams 208, 208' could be used. A generally rectangular, square, circular or triangular shape could be used, for example.

The components of the base frame 205 may be constructed from tubular steel. By way of non-limiting example, the tubular steel may be 1.5"×1.5" square tubing. Other dimensions, such as, for example, 2"×2," may also be used as desired to increase the strength and stability of the base frame 205. In such cases, it is understood that persons of skill in the art will recognize that weight may then be a concern. Persons of skill in the art will likewise recognize that other materials providing adequate strength and stability could also be used, such as, for example, carbon fiber products, plastics, other metals, and graphite to name a few. The components may be seam welded together, or may be fastened in any manner known in the art, such as, for example, through the use of glue, screws or rivets. Alternatively, the components may be integrally formed.

First and second posts 209, 209' may each be fixed to a respective end of the base frame 205 and extend upward from the frame 205 in a manner substantially orthogonal to the plane of the frame 205. First and second posts 209, 209' may each include an inwardly extending extension with a handle portion at an end thereof, as previously described with respect to the first and second posts 109, 109', for example. First and second posts 209, 209' may also each include an upper post section and a lower post section, as previously described with respect to the first and second posts 109, 109', for example.

The substantially enclosed track 240, which is mounted to the base frame 205, may be any of a variety of shapes, such as, for example, generally circular, oblong or elliptical in shape. The track 240 may substantially form a circle around the axis C, for example. In addition, the track 240 may include a pair of rails 241 and 242, which may be attached to one another by cross-braces 243*a-f*.

The rotatable platform 280, which is mounted to the rolling mechanism 260, may be any of a variety of shapes, such as, for example, generally circular, square, rectangular, oblong or elliptical in shape. The platform 280 may rotate in a plane that forms an angle γ with the plane of the base frame 205 and may revolve around the axis C. Also, the connection between a bottom surface 281 of the platform 280 and the rolling mechanism 260 may include ball bearings.

The rotatable platform 280 may be configured with a resistance mechanism that includes a weight holding device or a means to resist the twisting of bearings on which the rotatable platform 280 is mounted. Such a resistance mechanism may be formed as a pair of upwardly extending posts, which are designed and configured to hold one or more platen weights on the surface of the platform 280, for example. The weights increase the rotational inertia of the platform 280 making it increasingly more difficult for a user to turn the platform and thereby increasing the effort necessary to perform the exercise. As yet a further alternative, the resistance mechanism of the rotatable platform 280 could be a magnetic or friction based resistance mechanism applied to the rotational motion of components (such as turntables, for example) that permit rotation of the rotatable platform 280.

The rolling mechanism 260 may include two pairs of wheels 265*a* and 265*b*, each of which is mounted on an axle (not shown), which in turn is mounted to a frame 267 of the rolling mechanism 260. The wheels of each of the two pairs of wheels 265*a*, 265*b* may be spaced such that, when the rolling mechanism 260 is positioned on the track 240, the wheels will ride on the rails 241 and 242.

It will therefore be readily understood by those persons skilled in the art that the embodiments and alternatives of an exercise device and method are susceptible to a broad utility and application. While the embodiments are described in all currently foreseeable alternatives, there may be other, unforeseeable embodiments and alternatives, as well as variations, modifications and equivalent arrangements that do not depart from the substance or scope of the embodiments. The foregoing disclosure is not intended to be construed to limit the embodiments or otherwise to exclude such other embodiments, adaptations, variations, modifications and equivalent arrangements, the embodiments being limited only by the claims appended hereto and the equivalents thereof.

What is claimed is:

1. An exercise device comprising:

a frame including a base frame, the base frame having a center;

a vertical reference axis located substantially at the center of the base frame;

an arm portion rotatably connected to and extending from the base frame, the arm portion being adjustable and configured to form a plurality of angles with the base frame; and a platform rotatably mounted on the arm portion, the platform having a generally flat upper surface for supporting both feet of a user, whereby allowing the user to perform a substantially complete revolution of the user's lower extremities around the axis; and a pillar extending substantially orthogonally from the base frame to the arm portion, the pillar having an adjustable height.

2. The exercise device of claim 1, wherein a connection between the platform and the arm portion is adjustable and the platform is configured to be mounted on the arm portion at a plurality of distances from the center of the base frame.

3. The exercise device of claim 1, wherein a connection between the arm portion and the base frame includes a ball bearing.

4. The exercise device of claim 1, wherein a connection between the platform and the arm portion includes a ball bearing.

5. The exercise device of claim 1, wherein the frame further comprises first and second posts extending substantially orthogonally from substantially outer ends of the base frame.

6. The exercise device of claim 5, wherein the first and second posts each support a handle.

7. The exercise device of claim 1 further comprising a wheel and an axle, wherein the wheel is mounted on the axle and the axle is connected to the pillar.

8. The exercise device of claim 7, wherein the wheel is positioned such that the wheel will assist the pillar in revolving around substantially the center of the base frame.

* * * * *